US005369937A

United States Patent [19]

Logothetis

[11] Patent Number: 5,369,937

[45] Date of Patent: Dec. 6, 1994

[54] CONTINUOUS CASTING AND PACKAGING

[75] Inventor: Emanuel Logothetis, Edison, N.J.

[73] Assignee: Joule' Inc., Edison, N.J.

[21] Appl. No.: 58,207

[22] Filed: May 10, 1993

[51] Int. Cl.[5] ..... B65B 47/02

[52] U.S. Cl. ..... 53/453; 53/122; 53/559

[58] Field of Search ..... 53/122, 373.4, 428, 53/453, 559

[56] References Cited

U.S. PATENT DOCUMENTS

| | | | |
|---|---|---|---|
| 3,577,700 | 5/1971 | Bippus | 53/453 |
| 3,673,760 | 7/1972 | Canemero | 53/453 |
| 3,874,143 | 4/1975 | Braber | 53/453 |
| 4,094,127 | 6/1978 | Romagnoli | 53/559 |
| 4,233,801 | 11/1980 | Watt | 53/559 |
| 4,240,241 | 12/1980 | Sanborn, Jr. | 53/559 |
| 4,372,098 | 2/1983 | Mason | 53/453 |
| 4,565,052 | 1/1986 | Hautemont | 53/559 |
| 4,684,025 | 8/1987 | Copland et al. | 53/559 |
| 4,726,173 | 2/1988 | Giatti | 53/559 |
| 5,081,816 | 1/1992 | Cardinali | 53/559 |

*Primary Examiner*—W. Donald Bray
*Attorney, Agent, or Firm*—Stoll, Miskin, Previto & Hoffman

[57] ABSTRACT

A continuous casting and packaging mechanism in which a continuous body web of plastic material is fed to a station where molds are formed in the continuous body web. Casting material is extruded to the body web. A continuous cover web of plastic material is fed to overlie the body web. The cover web and the body web are sealed together to form a laminate. The superimposed webs are cured and molds are then remove from the webs. The mechanism may also be provided with a film heater to heat the body web, a mold release applicator to deposit a release the molds and mechanisms to place inserts into the molds as well as other mechanisms which may be used with the machine to continuously cast molds.

20 Claims, 1 Drawing Sheet

CONTINUOUS CASTING AND PACKAGING

BACKGROUND

The present invention relates to continuous casting of plastic shapes and more particularly to continuous casting of plastic shapes while simultaneously packaging the product.

Present mechanisms and methods of casting present several problems. One problem in existing mechanisms is the necessity of using conventional casting molds for the casting. Another problem is the fact that the finished product is separately placed in the selling package. In addition, it has been difficult to add additional non-cast components such as inserts to the packages. An important drawback of existing systems is the cost of product casting as well as the labor costs involved.

With existing casting procedures, high-volume sterile products cannot be cast economically. Since molds are recyclable an unlimited quantity of castings cannot be cured simultaneously. Since the product must be placed in its package it must be sterilized thereafter. Because of the high cost of the casting process, sterile products that have low product cost and high annual consumption volumes cannot be easily packaged without increasing the cost. The products cannot be made in intricate shapes with present mechanisms and are not suitable for sheet mold casting from low-density plastic materials.

OBJECT

The present invention avoids these problems and has for one of its objects the provision of an improved casting and packaging material which eliminates the necessity of conventional casting molds.

Another object of the present invention is the provision of an improved casting with which uses its selling package to shape the finished product.

Another object of the present invention is the provision of an improved casting method which may be used with products that contain additional non-cast components (commonly referred to as insert molding).

Another object of the present invention is the provision of all improved casting method which is economical being devoid of product casting costs and reducing labor costs.

Another object of the present invention is the provision an improved casting method in which the casting mold becomes the sterile sales package for the product.

The present invention permits high-volume sterile products to be cast economically. The absence of molds to recycle means that an unlimited quantity of castings can be cured simultaneously. Since the product is in its package, it is sterile and will remain so. Hence, the casting process of the present invention is ideal for sterile products that have low product cost and high annual consumption volumes. The products can be made in intricate shapes that would be suitable for sheet mold casting and are made from low-density plastic materials, such as reactor setting foam materials, that set with low pressures using time and/or temperature.

One application for the process of the present invention is packaging of disposable medical devices, cosmetics or any product that must be sterile because it comes in contact with people, such as noise ear plugs, etc.

Other and further objects of the invention will be obvious upon an understanding of the illustrative embodiment about to be described, or will be indicated in the appended claims and various advantages not referred to herein will occur to one ;skilled in the art upon employment of the invention in practice.

BRIEF DESCRIPTION OF THE DRAWING

A preferred embodiment of the invention has been chosen for purposes of illustration and description and is shown in the accompanying drawings forming a part of the specification, wherein.

DESCRIPTION

Figure 1:
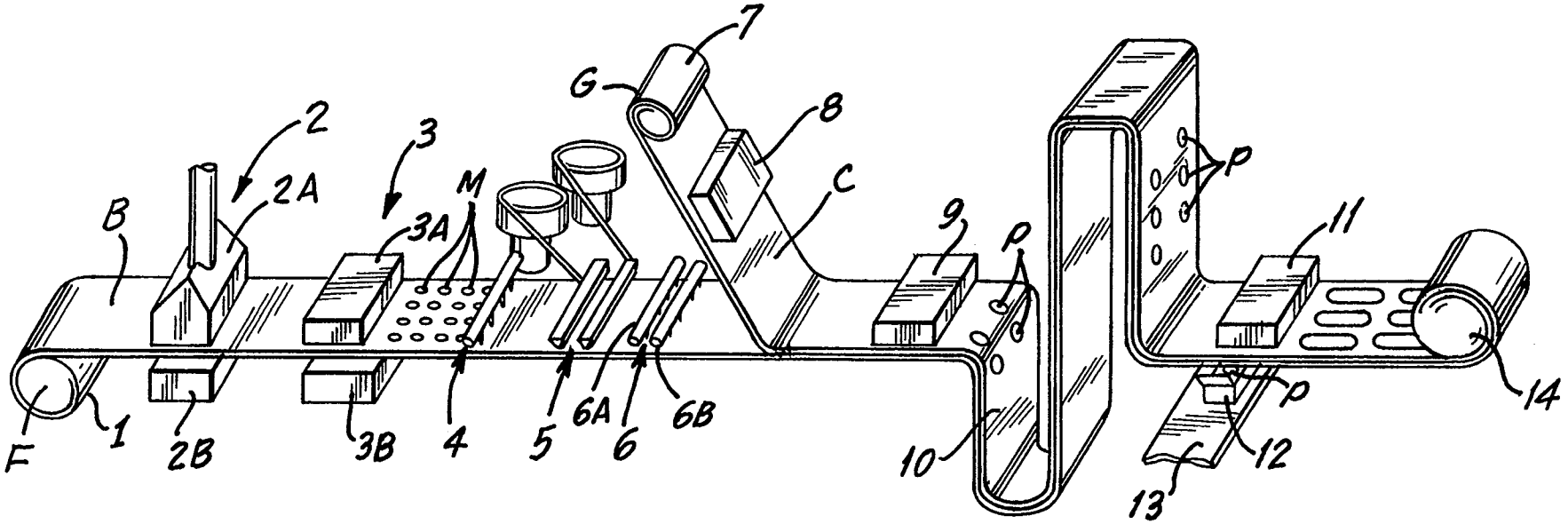
FIG. 1 is a schematic perspective view showing a simplified diagrammatic view of the present invention.

Referring to the drawings, the continuous casting system of the present invention comprises a film loader 1 for feeding a plastic body web B from a roll F in the form a continuous sheet. A film heater station assembly 2 having upper and lower components 2A and 2B between which the web B passes to be heated. A vacuum mold former or maker assembly 3 is provided which has upper and lower components 3A and 3B which form the molds M and is in advance of a mold release applicator assembly 4. An insert feed or placer assembly 5 is provided to place inserts in the molds M in advance of a pair of material extruder assembly 6 having components 6A and 6B.

A cover film loader 7 feeds a cover web C from a roll G in the form of a continuous plastic sheet. The web C is moved past a cover printer assembly 8 before it is laid over the body web B. A cover sealer assembly 9 is provided which seals the two webs B and C together after which they are moved past a curing accumulator assembly 10 to be cured.

A steel rule perforator assembly 11 is provided over a cartonizing conveyor assembly 13 which moves box loader 12 beneath the perforator 11 to catch the packages P as they are being separated from the combined webs B and C. Finally, a scrap unloader assembly 14 will remove the unused plastic webs B and C and recycle them.

The film loader 1 is in ! the form of a roll F and unwinds the body web B which is an elongated plastic sheet which moves past the various processing stations. The body film heaters 2A and 2B heat the plastic web B and make it pliable for forming into molds M. The mold maker assembly 3 makes the cavities M in the web B by applying vacuum and pressure from each side of the film. The mold release applicator 4 applies a) suitable mold release to the newly formed molds M. The inserter assembly 5 places any inserts that are required by the product into each of the molds M. The two extruders 6A and 6B deposit casting material into each mold M.

The cover loader 7 feeds the cover web C from a roll G and moves it over the body web B. The cover web printer 8 prints the necessary information on the cover web C. The cover sealer assembly 9 bonds the cover C to the body web B to complete the packages P The packages P comprise the lower web B and the upper web C with the inserts sealed in the webs M between the webs B and C. The accumulator assembly 10 holds the body webs F and cover web C long enough for the two to cure and set. The steel rule die perforator 11 cuts the web B and C into its unit components. The boxes 12 orientates the packages P and loads the packages P into boxes. The cartoner 13 moves the boxes 12 beneath the perforator 11 to catch the perforated packages.

The unused scrap plastic webs B and C is loaded onto the loader 14 for recycling.

It will be seen that the present invention provides an improved casting and packaging material which eliminates the necessity of conventional casting molds which uses its selling package to shape the finished product and which may be used with products that contain additional non-cast components (commonly referred to as insert molding).

The present invention also provides an improved casting method which is economical and is devoid of product casting costs, permits reduced labor costs and in which the casting mold becomes the sterile sales package for the product.

The present invention also permits high-volume sterile products to be cast economically. The absence of molds to recycle means that an unlimited quantity of castings can be cured simultaneously and because the product is in its package, it is sterile and will remain so, thereby making the casting process of the present invention ideal for sterile products that have low product cost and high annual consumption volumes.

The present invention also permits products to be made in intricate shapes that would be suitable for sheet mold casting and are made from low-density plastic materials, such as reactor setting foam materials that set with low pressures using time and/or temperature.

As many and varied modifications of the subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A continuous casting and packaging mechanism comprising means for feeding a continuous body web of plastic material, means for forming molds of a predetermined configuration in the continuous body web, means for depositing casting material into the molds in the body web, means for feeding a continuous cover web of plastic material over the body web, means for sealing the cover web and the body web together, whereby the cover web sealingly covers the molds in the body web, means of curing the superimposed webs with the casting material in the molds and means for removing the molds with the casting material therein from the webs.

2. A mechanism as set forth in claim 1 wherein a film heater is provided to heat the body web.

3. A mechanism as set forth in claim 2 wherein a mold release applicator is provided in order to apply mold release to the molds.

4. A mechanism as set forth in claim 3 wherein means are provided to place inserts into the molds.

5. A mechanism as set forth in claim 4 wherein a pair of extruding means is provided.

6. A mechanism as set forth in claim 5 wherein means are provided for printing data on the cover web.

7. A mechanism as set forth in claim 6 wherein said means for curing comprises accumulator means to accumulate the combined body and cover web.

8. A mechanism as set forth in claim 7 wherein perforating means are provided for removing the molds with the casting material therein from the webs.

9. A mechanism as set forth in claim 8 wherein means are provided to load the removed molds into packages.

10. A mechanism as set forth in claim 9 wherein means are provided to dispose of scrap webs.

11. A mechanism as set forth in claim 10 wherein said feeding means is a roller assembly.

12. A mechanism as set forth in claim 11 wherein said cover web feeding means is a roller assembly.

13. A mechanism as set forth in claim 12 wherein said scrap retriever is a roller assembly.

14. The method of continuous casting and packaging comprising feeding a continuous body web of plastic material, forming molds in the continuous body web, depositing casting material into the molds in the body web, feeding a continuous cover web of plastic material over the body web, sealing the cover web and the body web together, whereby the cover web covers the molds in the body web, curing the superimposed webs with the casting material in the molds and removing the molds with the casting material in the molds from the webs.

15. A method as set forth in claim 14 wherein heat is applied to the body web.

16. A method as set forth in claim 15 wherein mold release is applied to the molds in the web.

17. A method as set forth in claim 16 wherein inserts are placed into the molds.

18. A method as set forth in claim 17 wherein data is printed on the cover web.

19. A method as set forth in claim 18 wherein the combined body and cover web is accumulated during curing.

20. A method as set forth in claim 19 wherein the removed molds with the casting material therein are loaded into packages.

* * * * *